US009528706B2

(12) United States Patent
Montgomery et al.

(10) Patent No.: US 9,528,706 B2
(45) Date of Patent: Dec. 27, 2016

(54) SWIRLING MIDFRAME FLOW FOR GAS TURBINE ENGINE HAVING ADVANCED TRANSITIONS

(71) Applicants: Matthew D. Montgomery, Jupiter, FL (US); Richard C. Charron, West Palm Beach, FL (US); Jose L. Rodriguez, Lake Mary, FL (US); Bernhard W. Küsters, Jupiter, FL (US); Jay A. Morrison, Titusville, FL (US); Alexander R. Beeck, Orlando, FL (US)

(72) Inventors: Matthew D. Montgomery, Jupiter, FL (US); Richard C. Charron, West Palm Beach, FL (US); Jose L. Rodriguez, Lake Mary, FL (US); Bernhard W. Küsters, Jupiter, FL (US); Jay A. Morrison, Titusville, FL (US); Alexander R. Beeck, Orlando, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 396 days.

(21) Appl. No.: 14/105,313

(22) Filed: Dec. 13, 2013

(65) Prior Publication Data

US 2015/0167986 A1 Jun. 18, 2015

(51) Int. Cl.
*F23R 3/46* (2006.01)
*F04D 29/54* (2006.01)
(Continued)

(52) U.S. Cl.
CPC ..... *F23R 3/46* (2013.01); *F04D 29/542* (2013.01); *F04D 29/545* (2013.01);
(Continued)

(58) Field of Classification Search
CPC ..... F23R 3/02; F23R 3/04; F23R 3/42; F23R 3/425; F23R 3/46; F04D 29/52; F04D 29/54; F04D 29/541; F04D 29/542; F04D 29/544; F04D 29/545; F04D 29/547; F01D 9/041; F05D 2240/12; F05D 2240/127; F05D 2260/14
(Continued)

(56) References Cited

U.S. PATENT DOCUMENTS 2,857,740 A 10/1958 Hall et al.
3,524,318 A * 8/1970 Bouiller ..... F02C 3/067 415/60
(Continued)

FOREIGN PATENT DOCUMENTS

EP 2378082 A1 10/2011
EP 2538138 A2 12/2012

OTHER PUBLICATIONS

PCT International Search Report mailed Mar. 12, 2015 corresponding to PCT International Application No. PCT/US2014/069309 filed Dec. 9, 2014 (5 pages).

*Primary Examiner* — Steven Sutherland

(57) ABSTRACT

A gas turbine engine can-annular combustion arrangement (10), including: an axial compressor (82) operable to rotate in a rotation direction (60); a diffuser (100, 110) configured to receive compressed air (16) from the axial compressor; a plenum (22) configured to receive the compressed air from the diffuser; a plurality of combustor cans (12) each having a combustor inlet (38) in fluid communication with the plenum, wherein each combustor can is tangentially oriented so that a respective combustor inlet is circumferentially offset from a respective combustor outlet in a direction opposite the rotation direction; and an airflow guiding arrangement (80) configured to impart circumferential motion to the compressed air in the plenum in the direction opposite the rotation direction.

6 Claims, 8 Drawing Sheets

(51) Int. Cl.
*F23R 3/02* (2006.01)
*F23R 3/04* (2006.01)
*F23R 3/42* (2006.01)

(52) U.S. Cl.
CPC ..... *F04D 29/547* (2013.01); *F23R 3/02* (2013.01); *F23R 3/04* (2013.01); *F23R 3/425* (2013.01)

(58) Field of Classification Search
USPC ..... 60/751, 39.162; 415/211.2
See application file for complete search history.

(56) References Cited

U.S. PATENT DOCUMENTS 4,429,527 A 2/1984 Teets
4,462,204 A 7/1984 Hull
4,463,553 A * 8/1984 Boudigues ..... F01D 1/26 60/268
4,845,941 A 7/1989 Paul
5,338,155 A * 8/1994 Kreitmeier ..... F01D 25/30 415/211.2
5,555,721 A 9/1996 Bourneuf et al.
6,279,322 B1 8/2001 Moussa
6,589,015 B1 7/2003 Roberts et al.
6,647,730 B2 11/2003 Liu
7,025,566 B2 4/2006 Sasu et al.
7,827,798 B2 11/2010 Commaret et al.
8,079,804 B2 12/2011 Shteyman et al.
8,087,249 B2 1/2012 Ottaviano et al.
8,142,148 B2 3/2012 Hernandez et al.
8,276,389 B2 10/2012 Charron et al.
2002/0146320 A1 10/2002 Moussa et al.
2007/0017225 A1* 1/2007 Bancalari ..... F01D 9/023 60/752
2007/0113557 A1 5/2007 Schumacher et al.
2010/0040479 A1 2/2010 Spangler et al.
2010/0077719 A1 4/2010 Wilson et al.
2010/0115953 A1* 5/2010 Davis, Jr. ..... F01D 9/023 60/737
2011/0203282 A1 8/2011 Charron et al.
2012/0031068 A1* 2/2012 Charron ..... F01D 9/023 60/39.091
2012/0291452 A1* 11/2012 Moehrle ..... F23R 3/10 60/796

* cited by examiner

SWIRLING MIDFRAME FLOW FOR GAS TURBINE ENGINE HAVING ADVANCED TRANSITIONS

STATEMENT REGARDING FEDERALLY SPONSORED DEVELOPMENT

Development for this invention was supported in part by Contract No. DE-FC26-05NT42644, awarded by the United States Department of Energy. Accordingly, the United States Government may have certain rights in this invention.

FIELD OF THE INVENTION

The invention relates to imparting circumferential movement to compressed air flowing in a midframe of a gas turbine engine having a can annular combustor arrangement with tangentially oriented combustor cans.

BACKGROUND OF THE INVENTION

Conventional gas turbine engines that utilize can annular combustors include combustor cans to generate hot combustion gases, a transition duct to receive the hot gases and deliver them to a first row of guide vanes, where the guide vanes turn and accelerate the hot gases so they will be at a proper orientation and speed for delivery onto a first row of turbine blades. In these conventional arrangements the combustor can and the transition are angled radially inward but are otherwise aligned with the engine axis. Air is compressed by an axial compressor and slowed in a diffuser from which it then flows primarily axially into a plenum defined by the midframe. Once in the midframe the compressed air flows radially outward and back upstream toward combustor can inlets. Since the diffuser outlet and the combustor cans are concentric with the engine axis the compressed air flow is essentially radial and axially aligned with the engine axis, thus having no significant circumferential velocity.

Advances in gas turbine engine technology have yielded one configuration for a combustor arrangement where the combustor cans are not axially aligned with the engine axis. Such a configuration is described in U.S. Pat. No. 8,276,389 to Charron et al. and is incorporated herein in its entirety. Instead, in this configuration the hot gases are generated in the combustor cans and travel along respective flow paths and are delivered directly onto the first row of turbine blades without the need for the first row of vanes to turn and accelerate the hot gases. This is possible because the hot gases leave the combustor cans along a path that is already properly oriented for delivery directly onto the first row of turbine blades. Also, between the combustor cans and the first row of turbine blades each gas duct accelerates its respective flow of hot gases to the proper speed. Thus, the combustor arrangement dispenses with the need for the first row of turbine vanes.

In order to ensure the hot gases are properly aligned when leaving the combustor cans the combustor cans must align with a desired turbine flow path. An axis of this desired flow path may be aligned with a plane that is perpendicular to a radial of the engine axis and offset from the engine axis so that the flow leaving the combustor cans has a significant circumferential velocity that is required to drive the rotation of the first row of turbine blades. This arrangement is a significant departure from any previous arrangement, where the combustor cans are aligned with the engine axis, and hence there is room in the art for optimization.

BRIEF DESCRIPTION OF THE DRAWINGS

The invention is explained in the following description in view of the drawings that show.

DETAILED DESCRIPTION OF THE INVENTION

The present inventors have recognized that airflow within a midframe of can annular combustion arrangements using tangentially oriented combustor cans is different than when axially aligned conventional combustor cans are used. The inventors have further recognized that this different airflow may yield airflow characteristics that are not optimal. Consequently, the inventors have devised a solution that calls for introducing swirl into the flow of compressed air in the plenum, which can be accomplished in various ways. In this manner compressed air is aligned so that it flows in an aerodynamically efficient manner toward the combustor inlet. This allows for a reduced pressure drop, enables better uniformity of the flow of compressed air into the combustor, and reduced unsteadiness of the flow in the midframe, all of which can lead to increased engine efficiency and reduced unwanted emissions. Presented herein are several exemplary embodiments for implementing the solution for improving the alignment of air with combustor can. The presented exemplary embodiments, which are not meant to be limiting, include: design of the rear-stages of the compressor to achieve counter-swirl combined with a radially curved compressor exit diffuser; circumferential flow deflectors at the compressor exit diffuser exit; circumferential flow deflectors in the transition supports; and tangential baffles in the midframe.

Figure 1:
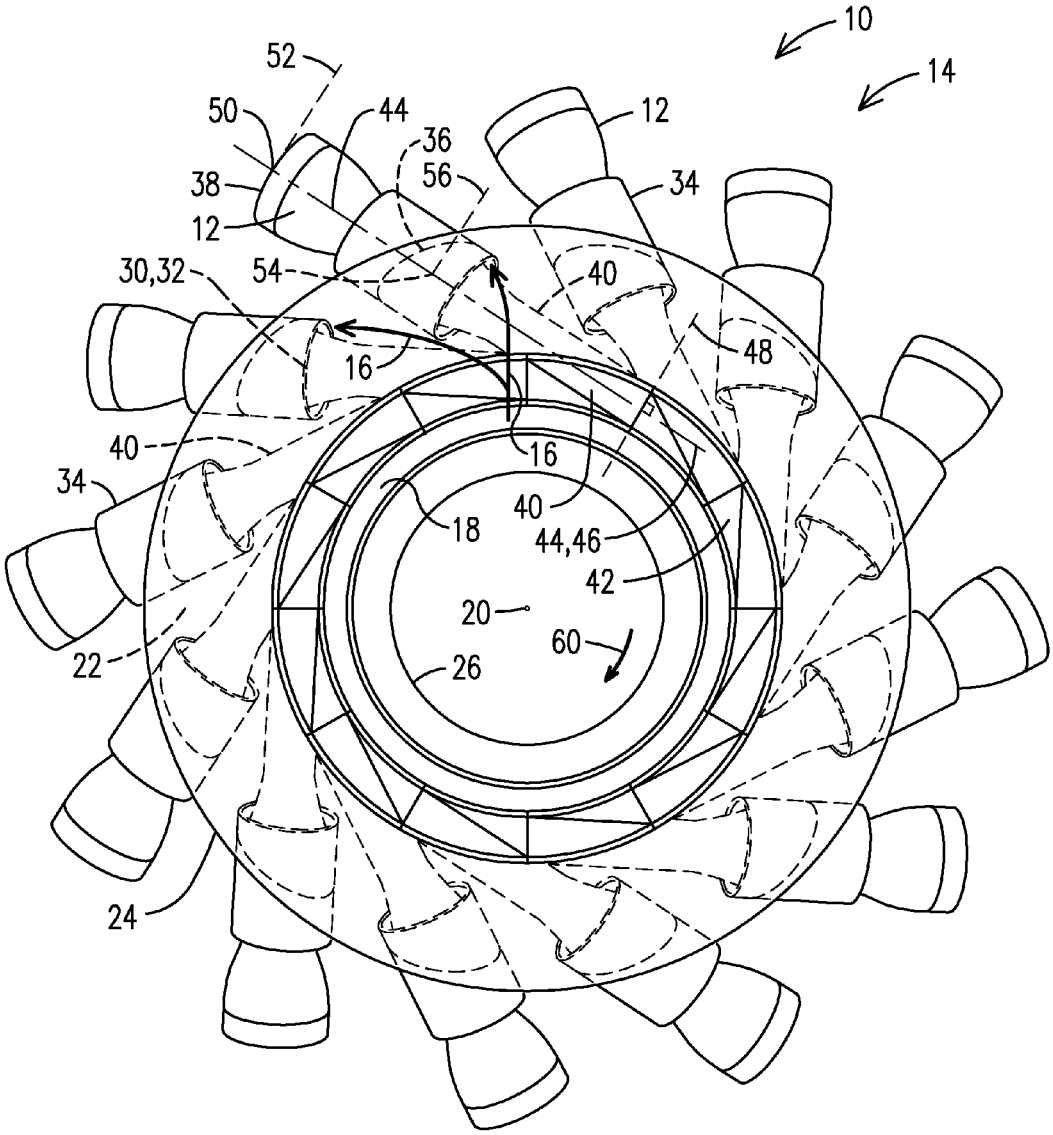
FIG. 1 is a schematic representation of a can annular combustor arrangement having tangentially oriented combustors disposed in a gas turbine engine midframe.

FIG. 1 is a schematic representation of an exemplary embodiment of a can annular combustor arrangement 10 having tangentially oriented combustors 12 disposed in a gas turbine engine midframe 14. In this figure the view is looking upstream from downstream. Thus, as shown the rotor shaft (not shown) would rotate clockwise. Conversely, when viewed from upstream the engine would be seen as rotating counter-clockwise. Air is compressed by an axial compressor (not shown), is slowed by a diffuser (not shown), and exhausts as compressed air 16 from a diffuser outlet 18. The combustor arrangement 10 and diffuser outlet 18 are concentric with an engine axis 20. Upon exhausting from the diffuser outlet 18 the compressed air 16 enters a plenum 22 defined by an outer casing 24 and a rotor casing 26. In this exemplary embodiment the compressed air enters a fluid path 30 through a fluid path inlet 32. The fluid path 30 may be defined by a flow sleeve 34 that surrounds a respective combustor can 12 and may traverse the outer casing 24 through a top hat opening 36. The fluid path 30 leads to a combustor inlet 38 of the combustor can 12 itself. Once in the combustor can 12 the compressed air 16 mixes with fuel, is ignited, and forms hot gases which travel through a respective flow duct 40 and to a turbine inlet 42. Other exemplary embodiments are envisioned where a flow sleeve may not be used to define a fluid path to the combustor inlet 38. However, regardless of what configuration is used, the concepts presented herein of aligning the flow of compressed air in the plenum 22 so that it is better suited for delivery to the combustor 12 can be applied. Therefore, while the discussion below describes an exemplary embodiment with a flow sleeve 34 defining a fluid path 30, it applies to other relevant configurations.

Each combustor can 12 is oriented so that it can deliver a respective flow of compressed air directly onto a first row of turbine blades (not shown) at the turbine inlet 42 without the need for a first row of turning vanes (not shown). To do this each combustor can 12 is canted radially outward and oriented tangentially to the turbine inlet 42. As a result, in this view of this exemplary embodiment, which is not meant to be a limiting geometry, a combustor axis 44 may lie in a plane 46 perpendicular to a radial 48 of the engine axis 20. The combustor axis 44 may directly intersect the annular turbine inlet 42 so that the hot gases have a straight flow path from the combustor can 12 to the turbine inlet 42. As a result, an inlet point 50 where the combustor axis 44 intersects a plane 52 of the combustor inlet 38 is offset axially upstream (toward the engine fore end) of an outlet point 54 where the combustor axis 44 intersects a plane 56 of a combustor outlet (not visible). Similarly, the inlet point 50 is offset circumferentially upstream of the outlet point 54 with respect to a direction of rotation 60 of the rotor shaft.

Figure 2:
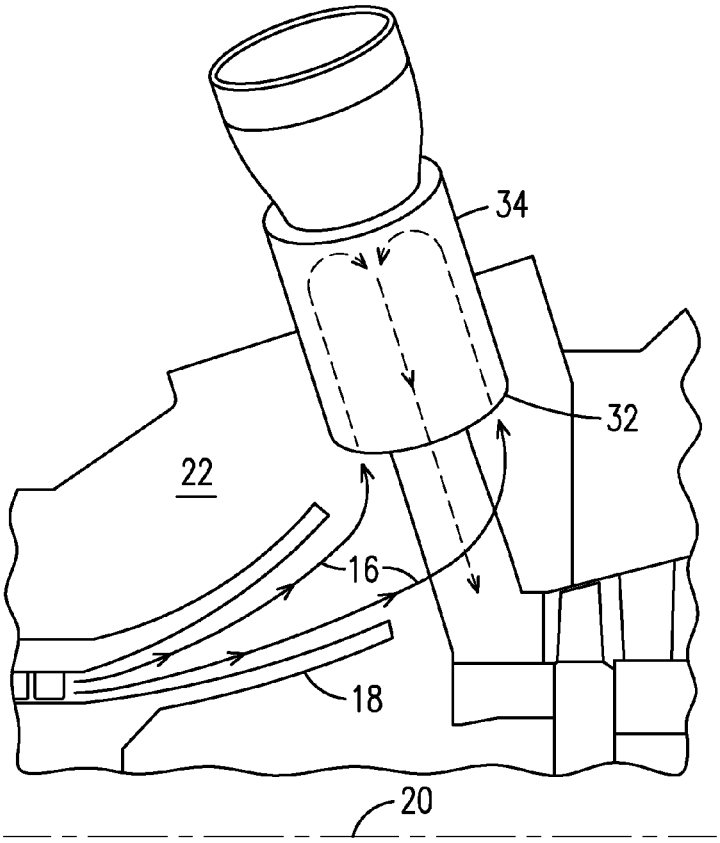
FIG. 2 is a schematic partial side view in the meridional plane of the can annular combustor arrangement of FIG. 1.

FIG. 2 shows a side view of a portion of the can annular combustor arrangement 10 of FIG. 1 showing the compressed air 16 as it exits the diffuser outlet 18 in an exemplary embodiment where the diffuser outlet 18 is curved radially outward. Upon exiting the diffuser outlet 18 the compressed air 16 direction of travel includes an axial component parallel to the engine longitudinal axis 20, a radially outward component, and a circumferential component.

The present inventors realized that the conventional arrangement of combustors cans that are axially aligned and pointing radially inward naturally benefit from a flow of compressed air that exhausts from the diffuser outlet 18 while flowing axially. However, the inventors recognized that this natural alignment is no longer present in the newer configurations such as the exemplary embodiment shown in FIG. 1. As a result of the orientation of the fluid paths 30 along the combustors 12, the compressed air 16 exiting the diffuser outlet 18 is drawn circumferentially against the direction of rotation 60. It was speculated that the compressed air 16 may travel a small circumferential distance and enter the nearest fluid path inlet 32, or it may travel farther circumferentially as indicated by the different arrows.

Figure 3:
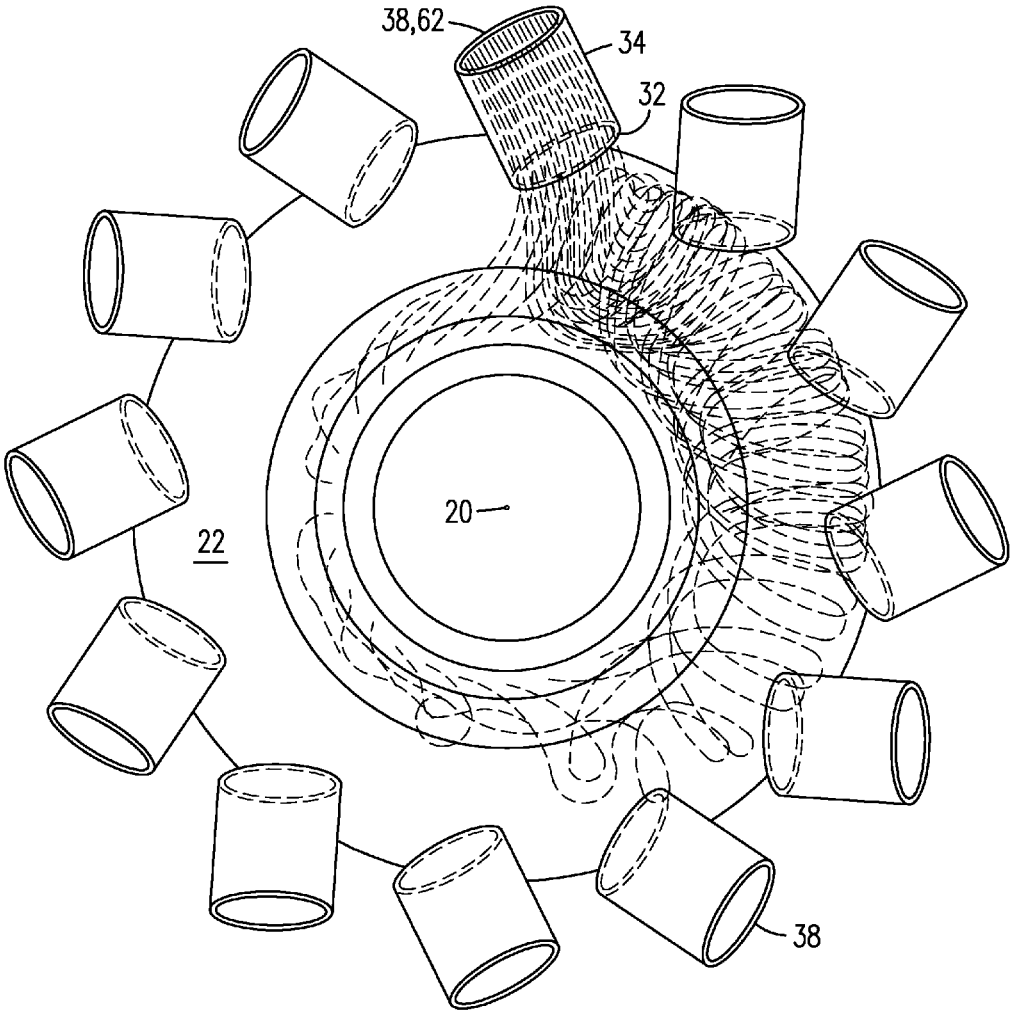
FIG. 3 is a model showing compressed air flowing into a single combustor can inlet of the can annular combustor arrangement like that of FIG. 1.

Travel of the compressed air 16 within the plenum was modeled to ascertain the extent of the circumferential travel. FIG. 3 is a schematic representation of compressed air flow within the combustion arrangement 10 of FIG. 1. The only streamlines shown are those that eventually end up entering the selected combustor inlet 62. This investigation brings to light the previously-unknown extent of circumferential travel the compressed air experiences. Compressed air 16 from every portion of the diffuser outlet 18 finds its way to the selected combustor inlet 62, sometimes experiencing unnecessary flow recirculation, and this results in unnecessary pressure drop between the diffuser outlet 18 and the selected combustor inlet 62. It was further determined that some compressed air 16 traveled clockwise in this view and this is incompatible with the counter-clockwise travel of most of the compressed air 16 entering the selected combustor inlet 62. These factors cause decreased velocity uniformity within the flow and also increased unsteadiness of flow in the midframe, both which could lead to non-uniform temperature of the combustor and an associated need for more cooling air, increased pressure loss of the midframe flow, increased combustor emissions due to non-uniform combustion, etc. All of these factors adversely affect engine efficiency and emissions.

Figure 4:
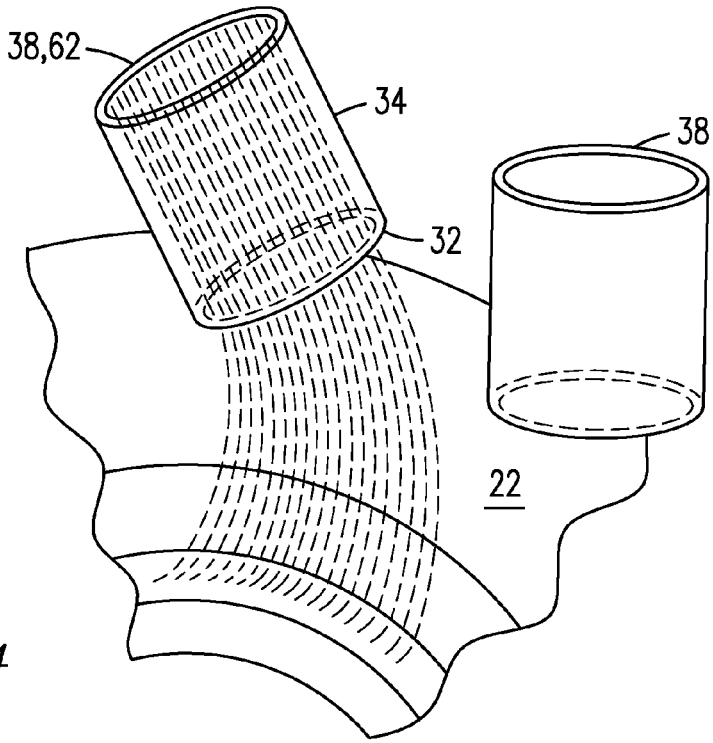
FIG. 4 is a model showing compressed air flowing into a single combustor can inlet of the can annular combustor arrangement like that of FIG. 1 when the compressed air has been counter swirled as disclosed herein.

To alleviate these problems the inventors have proposed to guide the flow such that it remains more cohesive and is more closely aligned with a fluid path to which it is being delivered. This may be accomplished by introducing a counter swirl in the compressed air 16 flowing through the plenum 22 in a manner depicted in FIG. 4 and as disclosed herein. This counter swirling flow of compressed air 16 travels in the plenum 22 in a direction of travel that may have an axial component parallel to the engine axis 20, a radially outward component, and a circumferential component in a direction opposite the direction of rotation 60 of the rotor shaft. The circumferential component can be introduced in various ways disclosed herein as well as equivalents that can be implemented by those of ordinary skill in the art. When implemented, this counter swirl will guide a direction of the flow of compressed air such that it is more closely aligned with, for example, a longitudinal axis of a fluid path between the combustor and a flow sleeve into which the compressed air will flow before entering the combustor through the combustor inlet. This alignment will increase flow uniformity and decrease flow unsteadiness, and therefore increase engine efficiency and reduce emissions.

Figure 5:
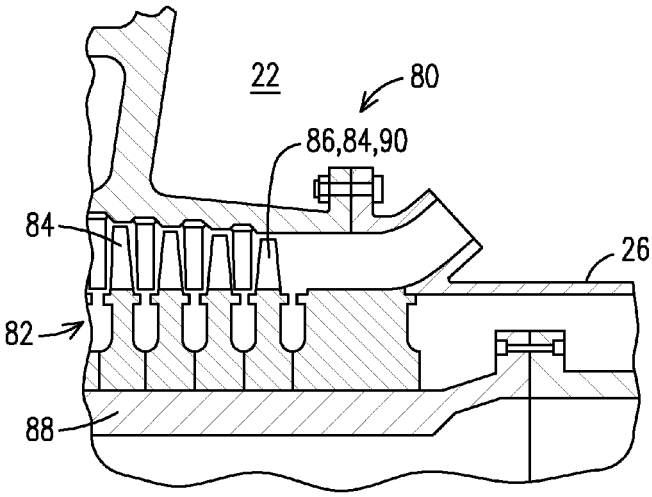
FIG. 5 is a schematic longitudinal cross section of an airflow guiding arrangement having a last row of rotating compressor blades configured to impart counter swirl.

FIG. 5 shows an exemplary embodiment of an airflow guiding arrangement 80 configured to impart circumferential motion to compressed air in the plenum 22. In this exemplary embodiment the counter swirl may be generated in the axial compressor 82 by specifically configured rotating blades 84. Specifically, a last row 86 of rotating blades 84, or alternately several of the aft rows of rotating blades 84, may be configured to guide the compressed air axially and counter to the direction of rotation 60 of the rotor shaft 88, as opposed to axially only or axially and with the direction of rotation 60. In order to accomplish this a last row of stator vanes, or outlet guide vanes (not shown) may be omitted, and an airfoil 90 of a blade in the last row 86 may be configured to impart a counter rotation to the compressed air that is greater than a rotation of the airfoil 90 such that compressed air ejected from the airfoil 90 experiences the desired counter swirl. Stated another way, the desired swirl counter to rotation could be achieved by redesigning the last stage or stages of compressor airfoils so that the swirling velocity of the compressed air flow exiting the compressor rotors exceeds the rotor swirl velocity. In this case the compressor outlet guide vanes, which typically remove swirl from the flow of compressed air before it enters the midframe, would no longer be required.

Figure 6:
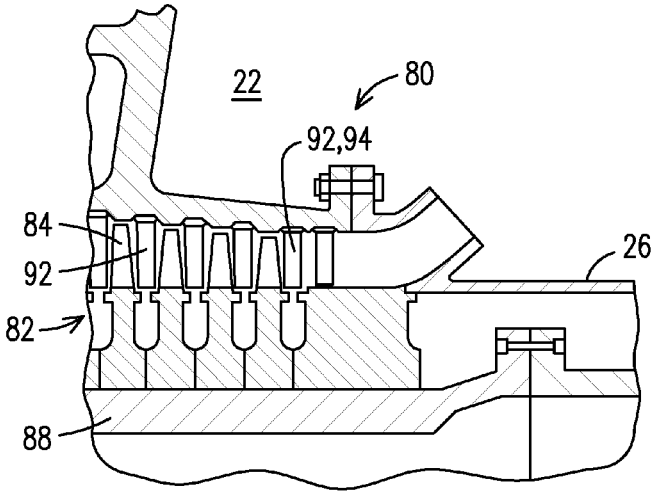
FIG. 6 is a schematic longitudinal cross section of an airflow guiding arrangement having compressor outlet guide vanes configured to impart counter swirl.

FIG. 6 shows an alternate exemplary embodiment of the airflow guiding arrangement 80 as part of the axial compressor 82. In conventional configurations the last row or optionally, rows of stator vanes 92, known as outlet guide vanes 94, straighten the flow of compressed air so that it exits the axial compressor 82 flowing in an axial direction. In this exemplary embodiment the last row of stator vanes 92 can be reconfigured so that circumferential motion counter to the direction of rotation 60 is imparted to the compressed air. This may be accomplished by one or several rows of outlet guide vanes 94. Since the additional turning is relatively small, on the order of a few degrees, this can be achieved without difficulty. Alternately, the outlet guide vanes 94 may be used together with the reconfigured last row 86 of rotating blades 84 of the exemplary embodiment of FIG. 5 to induce the counter swirl. Imparting circumferential motion in the compressor requires the least amount of actual flow redirection because the flow has a relatively long distance to travel before it reaches the fluid path inlet 32 and as the axial component of velocity decreases through the diffuser and midframe the swirl angle will increase. However, the correction requires more accuracy because any errors will amplify as the compressed air travels the relatively longer distance.

Figure 7:
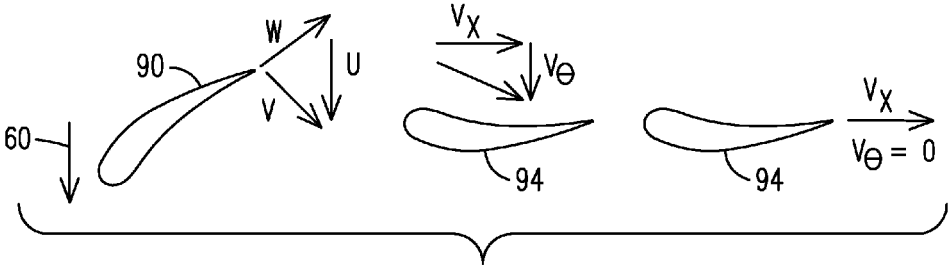
FIG. 7 depicts velocity triangles of a prior art configuration where counter swirl is removed by the outlet guide vanes.

FIG. 7 depicts velocity triangles of a prior art compressor 82 that uses outlet guide vanes 94 to remove swirl. Here is can be seen that compressed air leaves the airfoil 90 with a relative velocity W (relative to the airfoil 90), a wheel speed U, (a velocity imparted by the rotor), and a resulting absolute velocity V. In the prior art arrangement the absolute velocity of the compressed air leaving the airfoil includes an axial velocity $V_x$ and a circumferential velocity $V_\Theta$ in the same direction as the direction of rotation 60 of the rotor shaft 88. Subsequently the first outlet guide vane 94 straightens the flow (reduces the circumferential velocity $V_\Theta$). If the first row of outlet guide vanes 94 is not enough to fully straighten the flow an optional second row of outlet guide vanes 94 eliminates any remaining circumferential velocity $V_\Theta$ and thereby straightens to the flow.

Figure 8:
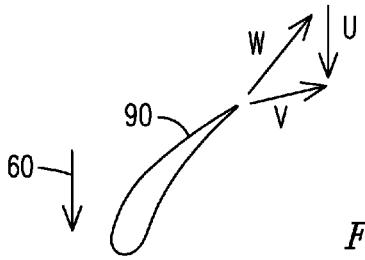
FIG. 8 depicts a velocity triangle in an exemplary embodiment where the blades impart counter swirl and the outlet guide vanes are removed.

In contrast, FIG. 8 depicts velocity triangles for an exemplary embodiment where the outlet guide vanes have been removed. The airfoils 90 have been reoriented to permit a relative velocity having an greater circumferential component than the prior art of FIG. 7. As a result the absolute velocity V also includes a circumferential velocity $V_\Theta$, but in this embodiment the circumferential velocity $V_\Theta$ is in the opposite direction of the direction of rotation 60. The absolute velocity V in this embodiment is thus a counter swirl.

Figure 9:
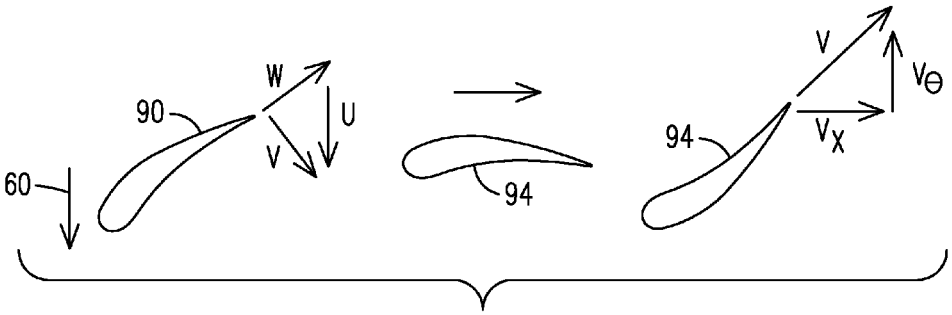
FIG. 9 depicts velocity triangles in an exemplary embodiment where outlet guide vanes increase an amount of counter swirl.

FIG. 9 depicts velocity triangles for an alternate exemplary embodiment where outlet guide vanes 94 are used to create or augment circumferential velocity $V_\Theta$. If the airfoils 90 are oriented similar to those of the prior art where there is a positive swirl, then the outlet guide vanes 94 can be configured to overcome the positive swirl and form the counter swirl. This configuration of outlet guide vanes 94 may be useful in a retro-fit, for example, where the original compressor is retained. If the airfoils 90 are oriented similar to those shown in FIG. 8, or if the airfoils 94 eliminate all circumferential velocity $V_\Theta$, yet more counter swirl is desired, then the outlet guide vanes can be configured to impart a circumferential velocity $V_\Theta$. In the exemplary embodiment of FIGS. 9 and 10 a conventional straight diffuser has been replaced with a curved diffuser 100. When swirl is imparted to the flow of compressed air exiting the compressor the flow has a tendency to migrate radially outward. This tendency can be used to advantage by using a curved diffuser 100 in conjunction with the swirling flow, thus allowing the flow to follow its preferred path while diffusing due to an increase in flow path cross sectional area due to the increased radius. The swirl angle desired at the combustor flow sleeve inlet plane is on the order of 30 degrees. However, the amount of swirl required in the compressed air exiting the axial compressor 82 to achieve this swirl angle is smaller; on the order of 10 degrees or less. This is because the swirl angle increases as the flow of compressed air is decelerated in the diffuser due to the fact that the stream-wise velocity decreases faster than the swirl velocity as the flow is decelerated and directed outwards. Consequently, curved diffusers 100 can be used effectively to impart counter-swirl in a configuration having a can annular combustor arrangement 10 having tangentially oriented combustors 12.

Figure 10:
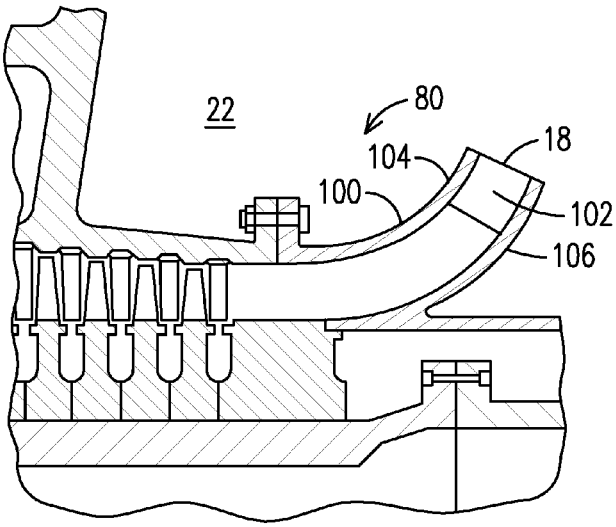
FIG. 10 is a schematic longitudinal cross section of an airflow guiding arrangement having an airflow guide in the diffuser configured to impart counter swirl.

FIG. 10 shows an alternate exemplary embodiment of the airflow guiding arrangement 80 as part of a diffuser. In this exemplary embodiment the circumferential motion is imparted in the curved diffuser 100 via supports 102 disposed proximate the diffuser outlet 18. These supports 102 may already exist and serve the function of holding an outer ring 104 of the curved diffuser 100 in place with respect to an inner ring 106. However, instead of being oriented radially in the already-existing configuration, the supports 102 may be canted from the radial orientation. This cant may impart a circumferential motion to compressed air exiting the diffuser outlet 18 into the page or out of the page, depending on the desired direction. Imparting circumferential motion at the diffuser exit requires more flow turning than imparting swirl at the diffuser inlet because the axial velocity has been reduced along the diffuser. However, less accuracy may be required because there is less travel distance for any error to amplify.

Figure 11:
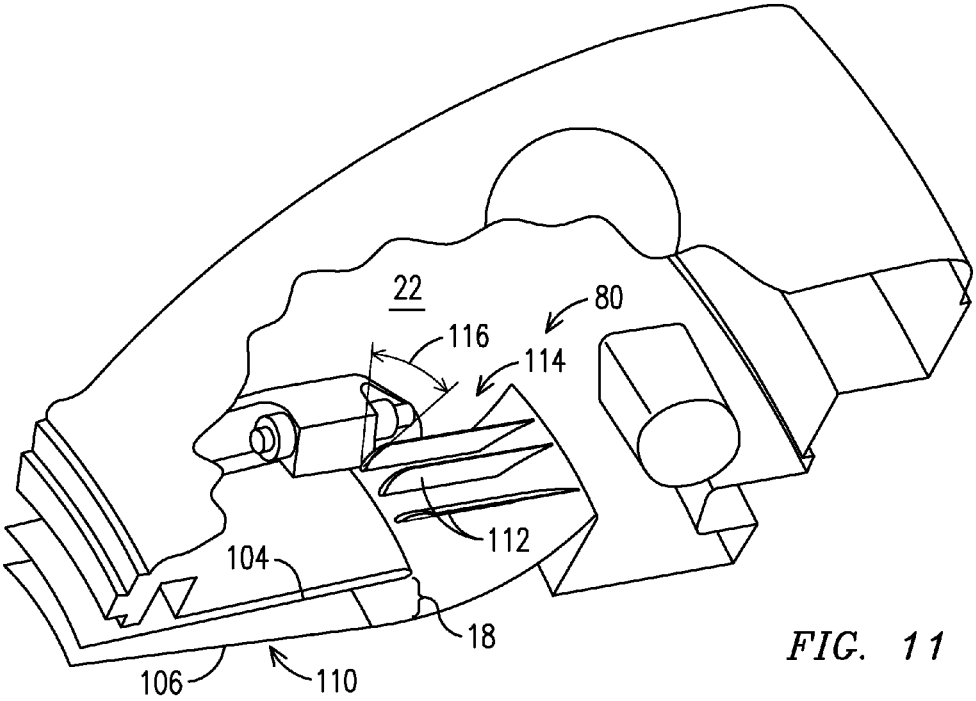
FIG. 11 is a perspective view of an airflow guiding arrangement having an airflow guide in the plenum adjacent the diffuser outlet configured to impart counter swirl.

FIG. 11 shows an alternate exemplary embodiment of the airflow guiding arrangement 80 positioned in the plenum 22 and immediately adjacent the diffuser outlet 18. In this configuration a conventional straight diffuser 110 is shown. Such a configuration may be encountered when a conventional can-annular combustion arrangement of an existing gas turbine engine is replaced with a tangentially oriented combustion arrangement. In this situation the original straight diffuser 110 may remain. The airflow guiding arrangement 80 includes circumferential airflow guides 112 arranged in an array 114 and configured to guide the compressed air circumferentially. The circumferential airflow guides 112 may optionally be in the shape of an airfoil. Each circumferential airflow guide 112 may be disposed at an angle 116 from a radial of the engine axis 20. Each array 114 may be associated with a combustor 12 and arranged to receive the compressed air exiting the diffuser outlet 18 and deliver it to a respective combustor 12. In an exemplary embodiment the array 114 may achieve circumferential turning on the order of 30 degrees. An orientation of individual circumferential airflow guides 112 may vary from one to the next and may be associated with the location of the individual circumferential airflow guides 112 in the array 114 and their respective position relative to the fluid path inlet 32. This way each circumferential airflow guide 112 can turn the compressed air more or less than another circumferential airflow guide 112. This allows for tailoring of individual circumferential airflow guides 112 in the array 114 so the array 114 can best direct the entirety of the compressed air flowing through it. In this exemplary embodiment the compressed air would be guided clockwise, which is desirable when the rotor shaft (not shown) is rotating counter-clockwise.

Figure 12:
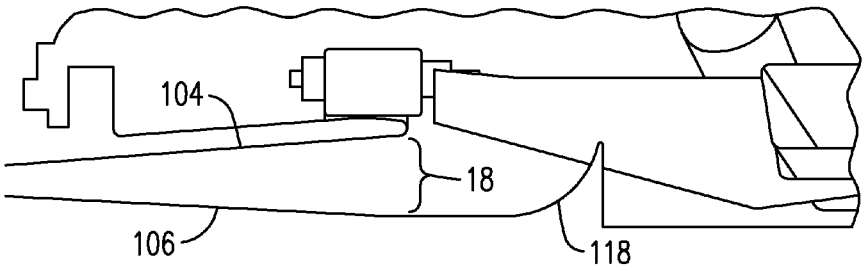
FIG. 12 is a schematic longitudinal cross section of an airflow guiding arrangement having an airflow guide in the plenum adjacent the diffuser configured to impart radial motion.

As can be seen in FIG. 12, a radial airflow guide 118 may also be used with the conventional straight diffuser 110 to guide the compressed air radially outward. The radial airflow guide 118 may include openings to permit some of the compressed air to travel past the radial airflow guide 118 to cool downstream components in the turbine. Alternately, the radial airflow guide could be constructed in circumferential segments with gaps between the segments to permit the flow to pass. Alternately, there may be a gap between the midframe inner surface and the radial airflow guide 118 through which compressed air could pass. When used with the circumferential airflow guides 112 the flow of compressed air is kept more coherent and can be guided with much more control in any direction desired. The airflow guides may be mounted in any suitable manner known to those in the art. Imparting circumferential motion in the plenum requires potentially the most flow redirection, but can enable the greatest accuracy since there is relatively very little remaining distance for the compressed air to travel before reaching the fluid path inlet 32.

Figure 13:
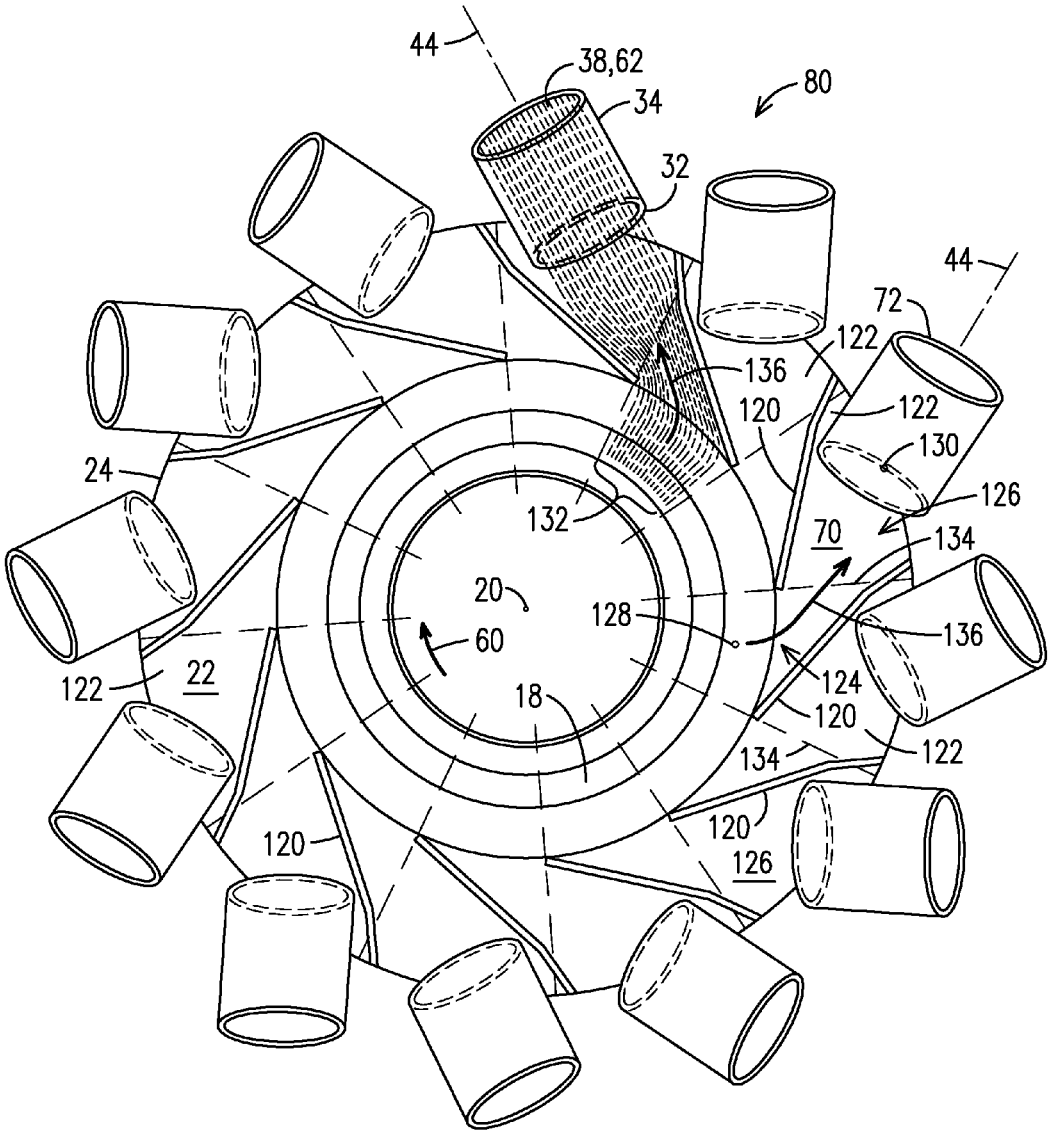
FIG. 13 is a schematic cross section of an airflow guiding arrangement having canted baffles.

FIG. 13 is a schematic representation showing compressed air flowing within an alternate exemplary embodiment of the airflow guiding arrangement 80 positioned in the plenum 22. Similar to FIG. 3, FIG. 13 shows all of the compressed air flowing into the selected fluid inlet 32 and associated combustor inlet 62. The streamlines are different due to the presence of tangentially oriented baffles 120 that impose circumferential motion to a certain degree, but restrict excess circumferential motion. These baffles 120 are tangential to a circle that is concentric with the engine axis 20, and in the most general sense means that the baffles 120 are canted from a purely radial orientation. The baffles 120 divide the plenum 22 into sectors 122, where each sector 122 is associated with an associated combustor 12, and hence an associated fluid path inlet 32, an associated fluid path 30 between the combustor 12 and an associated flow sleeve 34, and an associated combustor inlet 38. Each sector includes a radially inward end 124 and a radially outward end 126 that is circumferentially offset from the radially inward end. Stated another way, the radially inward end 124 is centered about a radially inward end clocking position 128, the radially outward end 126 is centered about a radially outward end clocking position 130, and the outward end clocking position 130 is disposed upstream of the inward end clocking position 128 in a direction opposite the direction of rotation 60.

The inward end clocking position 128 is associated with an arc-section 132 of an annulus of the diffuser outlet 18, and the arc-section 132 and associated radially inward end 124 of an associated sector 70 share common radial bounds 134. In contrast, the radially inward end 124 of the associated sector 70 need not align in any particular manner with the location of the radially outward end of the associated sector 70 or adjacent sectors. (The arc-section 132 selected for explanation is different than that which the streamlines are shown for sake of clarity of the drawing.) As a result, most of the compressed air exiting a particular arc-section 132 of the diffuser outlet 18 will enter the associated sector 70. The compressed air will travel radially outward within the associated sector 70 while the baffles 120 impart a circumferential motion in the direction opposite the direction of rotation 60. The radially outward end 126 of the associated sector 70 encompasses the fluid path inlet 32 of the combustor 72 that is associated with the associated sector 70. Consequently, the compressed air in the associated sector 70 is guided toward the fluid path inlet 32 and eventually to the combustor inlet 38 of the associated combustor 72. The associated combustor 72 is located circumferentially upstream of the particular arc-section 132 that supplies most of its compressed air.

The associated combustor 72 is aligned with its combustor axis 44, and hence the respective flow sleeve 34 and fluid path 30 are also aligned with the combustor axis 44. The baffles 120 guide compressed air that is traveling radially as it exits the diffuser outlet 18 so that a direction 136 more closely aligns with the combustor axis as the compressed air enters the fluid path inlet 32. The baffles 120 may have perforations located in a select portion, portions, or throughout the entirety of the baffle 120. This mitigates any pressure difference between sectors 122. The baffles 120 may span as much as the plenum 22 as possible, or alternately, the baffle may not be as large as the plenum 22. Instead of spanning from proximate the diffuser outlet 18 to proximate the outer casing 24 to proximate the turbine (not shown) etc, one or more of the baffles 120 may span less. As used herein proximate means close enough to provide a maximum sealing effect while leaving a sufficient gap to accommodate dimensional changes experienced during operation. In one exemplary embodiment this gap may be approximately 20 mm, but a final size would depend on the expected movement within the engine. The baffles may be mounted in any suitable manner known to those in the art.

Figure 14:
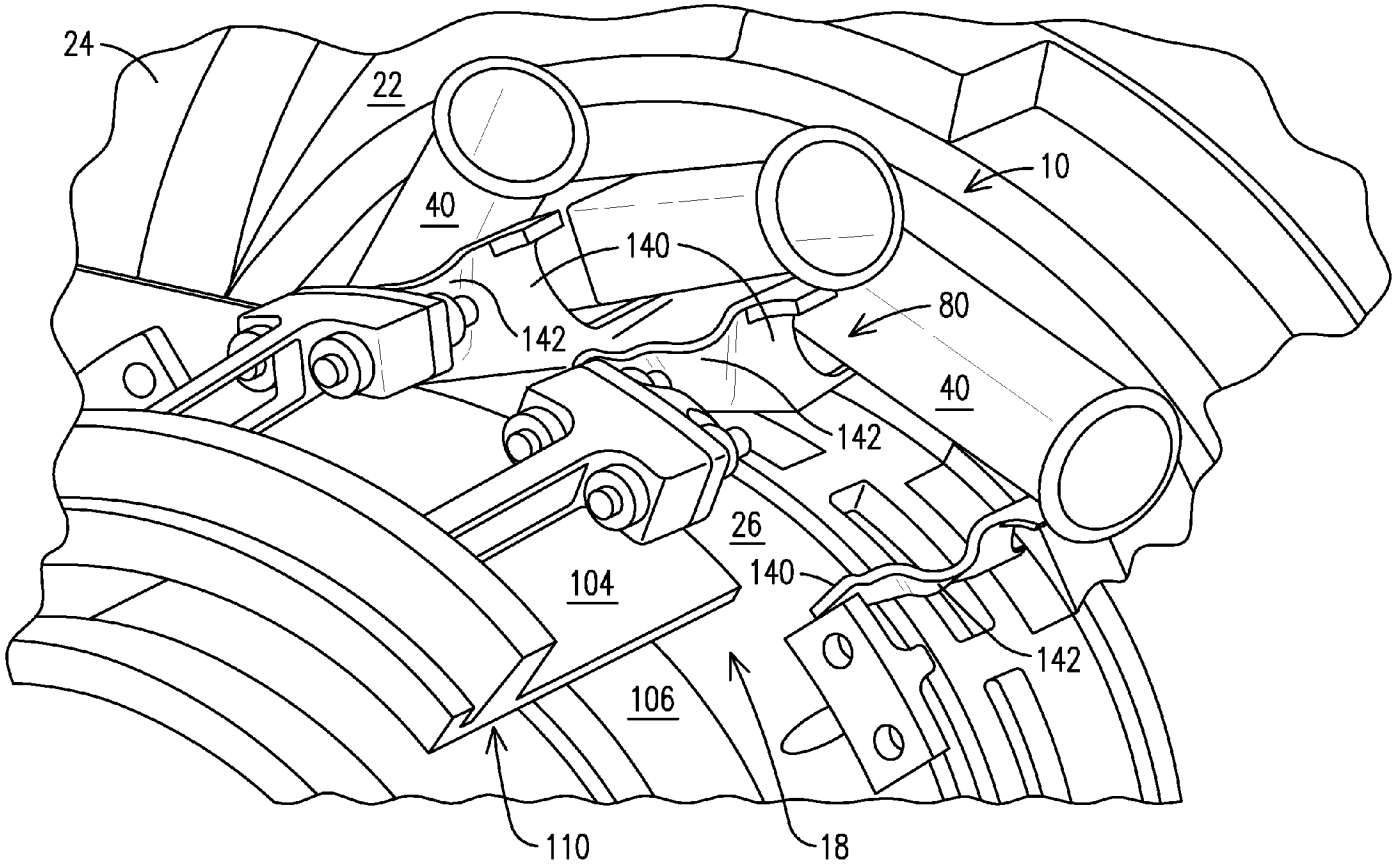
FIG. 14 is a perspective view looking toward the aft end of a gas turbine engine of a support structure having a flow guiding surface.

FIG. 14 shows yet another alternate exemplary embodiment of the airflow guiding arrangement 80 positioned in the plenum 22. In this exemplary embodiment the can annular combustor arrangement 10 having tangentially oriented combustors 12 (not shown) is supported at least in part by supports 140 disposed in the plenum 22. Conventionally these supports 140 may simply be flat and radially oriented to accomplish their support role. However, in the exemplary embodiment shown the support 140 may be modified so that it serves a dual role of a structural support as well as a flow guide. As air exiting the diffuser outlet 18 turns radially outward it would encounter the supports. A portion of the support 140 is formed as an airflow guide 142 and imparts circumferential motion to the compressed air flowing across it. The airflow guide 142 causes the direction of flow of the compressed air to more closely align with the combustor axis 44 (not shown).

Figure 15:
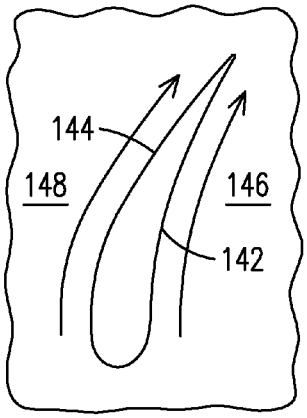
FIG. 15 is a cross section of an alternate exemplary embodiment of the flow guiding surface of the support structure of FIG. 14.

FIG. 15 shows an alternate exemplary embodiment of the airflow guide 142 of the support 140 of FIG. 14. In this exemplary embodiment the airflow guide 142 may take the form of an airfoil 144 having a pressure side 146 and a suction side 148 that aerodynamically guide the compressed air circumferentially. The airflow guides 142 can be part of any structure in the plenum 22 or may exist independently within the plenum 22.

From the foregoing it is apparent that the inventors have recognized the loss of an aerodynamic benefit resulting from a combining a conventional axially aligned midframe flow, associated with axially aligned combustors, with tangentially aligned combustors. In response, the inventors have conceived of a solution that can be implemented in a variety of ways to establish an optimal aerodynamic relationship by introducing swirl in the compressed air in the midframe plenum when tangentially aligned combustor cans are used. This optimization increases engine efficiency and lowers emissions, and thus represents an improvement in the art.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A can-annular gas turbine engine combustion arrangement, comprising:

a rotor shaft rotating in a rotor shaft direction of rotation;

combustor cans each comprising a combustor outlet and a combustor inlet circumferentially offset from the respective combustor outlet in a direction opposite the rotor shaft direction of rotation;

an axial compressor;

a plenum in fluid communication with all combustor inlets and providing fluid communication between the axial compressor and the combustor inlets;

a means for inducing circumferential motion to compressed air in the plenum in the direction opposite the rotor shaft direction of rotation, wherein the means for inducing circumferential motion comprises at least one row of rotating compressor airfoils located upstream from a last row of the rotating compressor airfoils, the at least one row of rotating compressor airfoils configured to impart a counter swirl velocity greater than a velocity of rotation of the rotating airfoils; and a flow path for conveying the compressed air in the plenum to a respective combustor inlet of a respective combustor can.

2. The can-annular gas turbine engine combustion arrangement of claim 1, further comprising a curved exit diffuser.

3. The can-annular gas turbine engine combustion arrangement of claim 1, wherein the means for inducing circumferential motion further comprises a stationary row of guide vanes configured to impart counter swirl to the compressed air exiting the axial compressor.

4. A gas turbine engine can-annular combustion arrangement, comprising:

an axial compressor operable to rotate in a rotation direction;

a diffuser configured to receive compressed air from the axial compressor;

a plenum configured to receive the compressed air from the diffuser;

a plurality of combustor cans each comprising a combustor inlet in fluid communication with the plenum, wherein each combustor can is tangentially oriented so that a respective combustor inlet is circumferentially offset from a respective combustor outlet in a direction opposite the rotation direction; and an airflow guiding arrangement configured to impart circumferential motion to the compressed air in the plenum in the direction opposite the rotation direction, the compressed air in the plenum being conveyed through a flow path to a respective combustor inlet of a respective combustor can, wherein the airflow guiding arrangement comprises at least one row of rotating compressor airfoils located upstream from a last row of the rotating compressor airfoils, the at least one row of rotating compressor airfoils configured to impart a counter swirl velocity greater than a velocity of rotation of the rotating airfoils.

5. The gas turbine engine can-annular combustion arrangement of claim 4, the combustion arrangement further comprising a curved compressor exit diffuser.

6. The gas turbine engine can-annular combustion arrangement of claim 4, wherein the airflow guiding arrangement further comprises a stationary row of guide vanes configured to impart counter swirl to the compressed air exiting the axial compressor.

* * * * *